US006879255B1

(12) United States Patent
Jezierski

(10) Patent No.: US 6,879,255 B1
(45) Date of Patent: Apr. 12, 2005

(54) MAILBOXCAM INSTANTANEOUS REMOTE MAIL VIEWING SYSTEM

(76) Inventor: Scott Daniel Jezierski, 1461 Sherman Lake Rd., Lino Lakes, MN (US) 55038

( * ) Notice: Subject to any disclaimer, the term of this patent is extended or adjusted under 35 U.S.C. 154(b) by 32 days.

(21) Appl. No.: 10/666,675

(22) Filed: Sep. 18, 2003

Related U.S. Application Data

(60) Provisional application No. 60/412,913, filed on Sep. 23, 2002.

(51) Int. Cl.[7] ..... G08B 21/00; G08B 13/14
(52) U.S. Cl. ..... 340/540; 340/569; 232/17
(58) Field of Search ..... 340/540, 569, 340/570, 568.1; 232/17, 34

(56) References Cited

U.S. PATENT DOCUMENTS 6,114,959 A 9/2000 Bennett
6,307,472 B1 * 10/2001 Robertson ..... 340/569
6,715,669 B2 * 4/2004 Hara ..... 232/45
2002/0024438 A1 2/2002 Roberson

* cited by examiner

*Primary Examiner*—John Tweel, Jr.
(74) *Attorney, Agent, or Firm*—Dale Montgomery

(57) ABSTRACT

An instantaneous remote mail viewing system comprising an instantaneous analog video transmission device mounted inside a mailbox, an analog video receiver that receives and transmits a video image to a video monitor or television and a remote transmitter that activates the analog video transmission device only while the remote transmitter is activated. The analog video transmission device is normally in a low power, standby mode that has a minimal power drain. The unit is transmitting only when activated by the user and reverts to the normal low power, standby mode when the user releases the activation switch.

12 Claims, 5 Drawing Sheets

MAILBOXCAM INSTANTANEOUS REMOTE MAIL VIEWING SYSTEM

CROSS-REFERENCE TO RELATED APPLICATIONS

This application is entitled to the benefit and filing date of Provisional Patent Application 60/412,913 filed Sep. 23, 2002. Applicant claims priority to provisional patent application 60/412,913 filed Sep. 23, 2002 pursuant to 35 USC paragraph 119e (i).

FIELD OF THE INVENTION

This invention relates to checking the presence of mail in a mailbox at a distance. In particular this invention relates to an apparatus and method to view the presence or absence of mail in a mailbox remotely and instantaneously.

BACKGROUND—DESCRIPTION OF THE PRIOR ART

It can be difficult to check the mailbox for mail in some situations. Some mailboxes are located a long distance from the residence, requiring driving or a long walk to reach the mailbox. Other mailboxes are closer but are difficult to reach during inclement weather such as cold, rain or snowstorms. Many inventors have attempted to solve this problem with varying success. Some of the inventions rely on a mechanical device that must be visible from the home to be accessible. While these devices may show that the mail has arrived, they may not be visible due to weather, poor visibility or terrain obstructions. Other inventors have attempted to solve the problem electronically by using sensors combined with radio transceivers to sense the arrival of mail and send the information to receiving devices such as a personal computer. Many of these devices are but electronic versions of earlier mechanical inventions and replace the line of sight problems with battery drain issues and inaccurate mail status information. In particular, U.S. Pat. No. 5,023,595 to Bennett, uses a door position switch along with a radio transmitter to communicate to the user if the mailbox door has been opened or not. The problem with this approach is that while it does communicate whether the door has been opened it cannot tell the user if mail has been placed in the mailbox. There are many instances where mail is left in the mailbox to be picked up by the U.S. Postal Service. The Bennett invention would only tell that the door on the mailbox has been opened and it must be assumed that the mail has been picked up. It does not include a way to verify that the mail has indeed been picked up or if other mail was delivered and left in the mailbox.

U.S. Pat. No. 5,239,305 to Murphy et al, describes a device that senses the opening of the mailbox door and transmits the information to the user. It does not tell the user if the mail was removed, if new mail was delivered or if a prankster or someone with ill intent has placed a potentially hazardous object in the mailbox. Other inventions that have these same flaws are U.S. Pat. Nos. 5,377,906, 6,433,684, 6,114,959 and 4,872,210. None of these inventions can verify that mail was removed and replaced with delivered mail, identify the object placed in the mailbox, or that mail was removed and the mailbox left empty.

Others inventions require the use of cell phones, personal computers or data handling and storage devices to retrieve the information about the contents of a mailbox. These inventions are unreasonably complex, use large amounts of power and can be costly to produce. U.S. patent application number 2002/0103868 to Kahn describes a complex system that requires a computer system to be able to check the presence or absence of mail. Not only is this system costly to build but it is difficult to operate due to its complexity. It is impractical for a single mailbox since it is inordinately expensive to manufacture. The Kahn, application does not give any method to identify potential suspicious objects in the mailbox that may contain dangerous materials, a serious flaw.

U.S. patent application number 2002/0024438 to Roberson also uses a data handling system that is unnecessarily complex and difficult to install for a single mailbox. This invention requires the added equipment of a mailbox control unit to store the information and some type of remote access device to retrieve the stored information. This invention describes the optional installation of a digital video camera to transmit a digital image to the mailbox control unit for information storage. The inclusion of the digital video camera allows viewing of the contents of the mail only in locations where the digital camera and transmission of data does not create an excessive power drain. Remote, single mailbox locations usually do not have the necessary power source at the mailbox itself and necessitate running a separate a power line to the mailbox.

While the Roberson application solves some problems it creates others that make it impractical in remote single-mailbox locations. The digital image must be transmitted at great power consumption and stored in a remote memory storage device. This data is then accessed remotely by using a cell phone or by computer access over the world wide web. The excessive power drain required to transmit the digital image and the long transmission time make this impractical for locations that do not have a connection to a permanent power source. This system is not instantaneous, requires the transmission of data to a storage device and remote access of the stored data using special equipment all showing the obvious disadvantages of the invention.

It is the object of this invention to create a device that has minimal power consumption using equipment that transmits an analog instantaneous image of the contents of the mailbox to the user on demand. The instantaneous image is only visible while the user maintains the operation of the unit by pressing a momentary contact switch insuring the power drain is minimal. After the user releases the switch, the device will enter an extremely low power wait mode until next accessed. The device is mounted inside the mailbox, is self-contained and does not require any power source other than batteries or optionally a solar charger to extend the battery life even longer.

The present invention will allow the user to instantaneously check the interior of the mailbox remotely to see if mail has been picked up and/or if new mail delivered. It also eliminates the potential risk to the user from acts of foul play or terrorism involving dangerous articles placed in the mailbox such as a pipe bomb. While these acts of terrorism are rare, they have occurred in the past and occur most often in rural or remote locations where the terrorist cannot be seen while placing the object in the mailbox.

SUMMARY OF THE INVENTION

The present invention of the instantaneous remote mail viewing system comprises an instantaneous analog video transmission device normally in standby, low power mode normally mounted inside a mailbox, an analog video receiver and a transmitter that activates the analog video transmission only as needed by the user.

Objects and Advantages

Accordingly, besides the objects and advantages of the instantaneous remote mail viewing system described in the above patent, several objects and advantages of the present invention are:

(a) to provide a device that can view the contents of a mailbox in real time from a remote location;

(b) to provide a device with low power drain and long battery life that can view the contents of a mailbox from a remote location;

(c) to provide a device that can view the contents of a mailbox from a remote location and transmit that information to a television or other video imaging device instantaneously;

(d) to provide a device that can view the contents of a mailbox in real time from a remote location that can be operated in a very low power standby mode while waiting for a remote transmit signal;

(e) to provide a device that can view the contents of a mailbox in real time from a remote location that has a minimum of components and can be installed quickly with a minimum of time.

Still further objects and advantages will become apparent from a consideration of the ensuing description and drawings.

BRIEF DESCRIPTION OF THE DRAWINGS

In the drawings, closely related figures have the same number but different alphabetic suffixes.

DETAILED DESCRIPTION

Figure 1A:
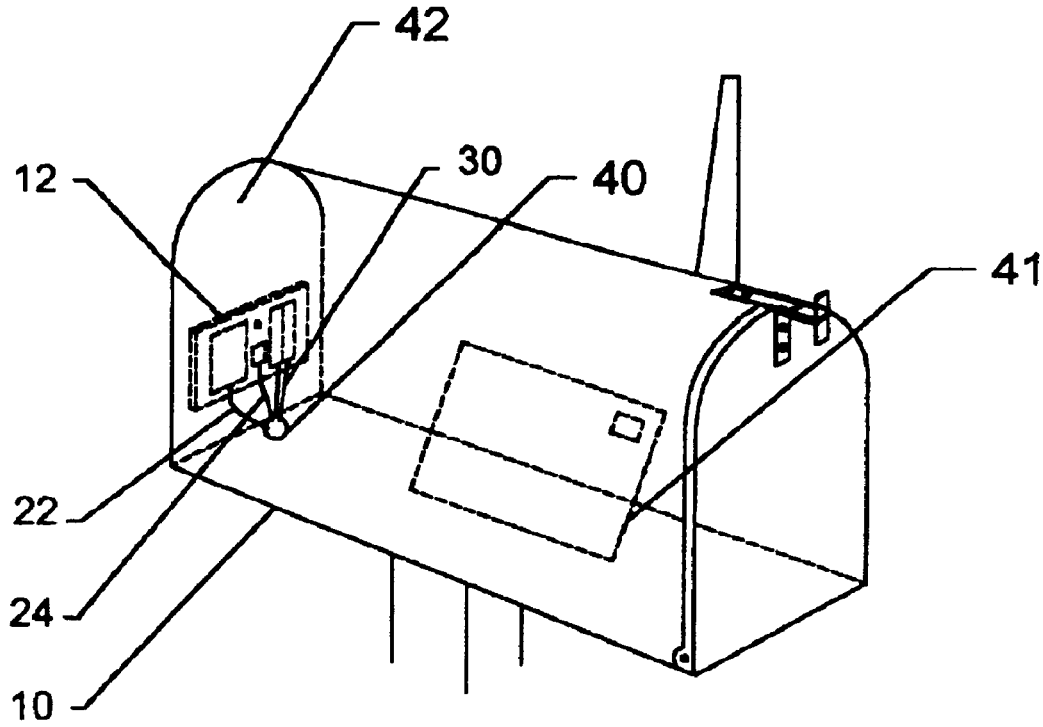
FIGS. 1A and 1B show the preferred mounting locations for the low power drain, instantaneous image transmission device and solar cells.
Figure 1B:
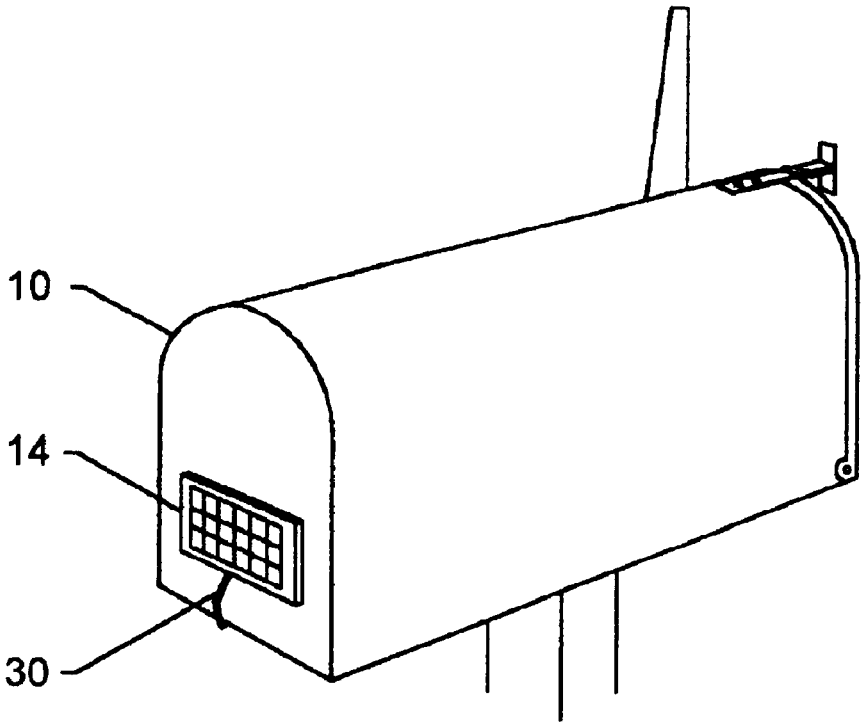

A preferred embodiment of the placement and installation of the present invention the mailbox 10 is illustrated in FIG. 1A and FIG. 1B. FIG. 1A shows the instantaneous image transmission device 12 mounted in the back 42 of mailbox 10. The device 12 located in the mailbox back 42 insures that multiple pieces of mail 41 can be viewed without any piece of mail covering another.

The antennae for remote RF receiver/controller 22 and the antennae for analog camera transmitter 24 can be routed through hole 40 in mailbox 10 for maximum transmission capability. In an alternate embodiment, both may be left loose to hang as space permits and do not need access hole 40 in mailbox 10.

The wires 30 connect instantaneous image transmission device 12 to the solar cell 14 in FIG. 1B. The connection of solar cell 14 may require drilling hole 40 in the bottom of the mailbox 10 if it does not have vent holes present in the mailbox. The preferred embodiment of solar cell 14 is a low power trickle-charge diode unit that will charge during sunlight exposure but not discharge during low light conditions.

Figure 2:
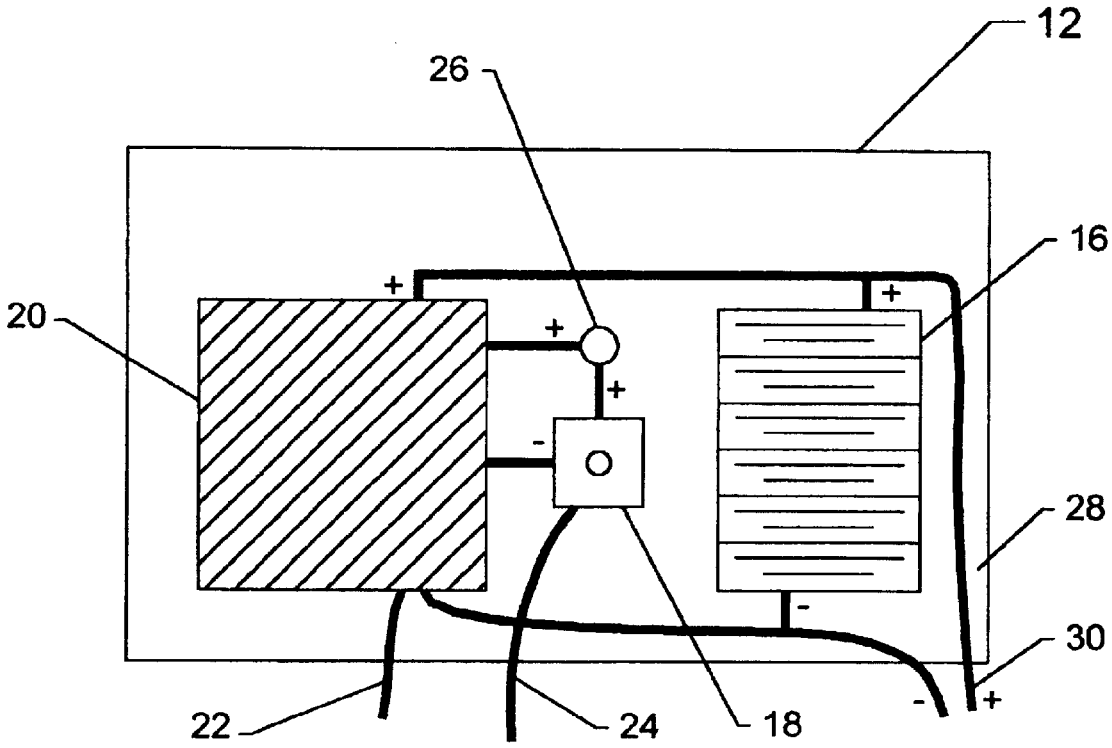
FIG. 2 shows the preferred assembly of the individual components for the low power-drain, instantaneous image transmission device.

The preferred embodiment of the detailed construction of instantaneous image transmission device 12 is shown in FIG. 2. The components of the device 12 can be mounted on the plastic mounting board 28. Mounting board 28 could also be an electronic circuit board as are well known in the arts but the plastic board lowers the risk of electrical shorts due to moisture condensation. A circuit board as a mounting board is an acceptable alternative construction. The battery power pack 16, the analog video camera 18 and RF transmitter 18, the remote RF receiver/controller 20, and the light source 26 can be mounted to mounting 28 board with adhesives or potting compounds. There are many other methods to mount components to boards.

In the preferred embodiment, battery power pack 16 can be wired in parallel with remote RF receiver/controller 20 and solar cell connecting wires 30. Battery pack 16 is preferably a 12 volt nickel-cadmium battery but other voltages and types of batteries may be used. The preferred analog video camera and RF transmitter 18 is miniature, a low power, color, CMOS unit. Black and white CMOS units may also be used. The preferred analog video camera and RF transmitter 18 operates on a standard transmission frequency of 900 to 1200 MHz, with a voltage range of 6 to 12 volts at a power output of 50 to 200 mw. The preferred analog video camera and RF transmitter 18 can operate at a minimum illumination of 3 LUX.

The preferred remote RF receiver/controller 20 and the matching remote RF transmitter 38 both contain a built in decoder/encoder respectively. The built-in encoder/decoder circuitry allows the user to setup unique combinations for isolated operation within close proximity to other units. The transmitter/receiver pair for the controller operates on separate transmission and receiving frequencies to avoid radio interference but may also operate on the same frequency or can be tuned to a specific individual frequency in an alternate embodiment. Remote RF receiver/controller 20 is well known in the radio controlled toy art and often used to operate radio controlled cars or other toys. These units operate in a low power standby mode while waiting for a signal. The negative power connection (ground) of the analog video camera and RF transmitter 18 is connected to the ground on remote RF receiver/controller 20. Analog video camera and RF transmitter 18 is wired in series with the light source 26. Light source 26 can be an LED light in the preferred embodiment but can also be made from halogen, incandescent or other types of light sources. The RF receiver/transmitter antennae 22 and the analog video camera antennae 24 are optimally fed through hole 40 in mailbox 10 to the outside and may be allowed to remain free and hang from the mounting board inside mailbox 10.

The entire device 12 can be enclosed in a clear plastic cover, plastic films, potting compounds or other materials to protect it from moisture.

Figure 3:
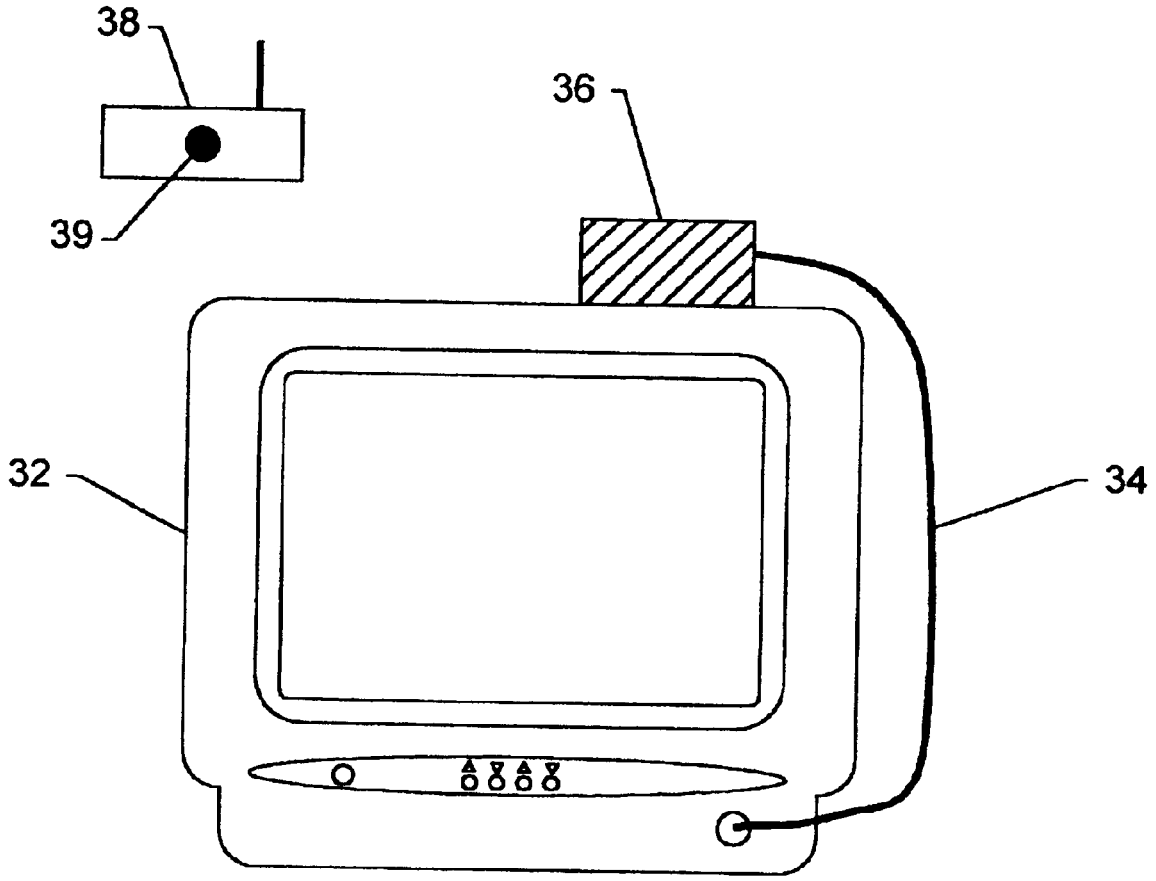
FIG. 3 shows the attachment of the video image receiver, attachment to the television set and the optional control switch.

In FIG. 3, RF receiver 36 is used to receive transmissions from instantaneous image transmission device 12 and converting information from the transmissions into a usable format and sending through the cable 34 to the television or video monitor 32. Battery powered RF transmitter 38 has a momentary contact switch 39 or toggle switch or other type of momentary contact switch to turn on RF transmitter 38 to transmit the power -on- command to the instantaneous image transmission device 12. In an alternate embodiment, a battery-powered transmitter 38 can be incorporated into receiver 36 by adding a radio transmitter and power switch.

Figure 4:
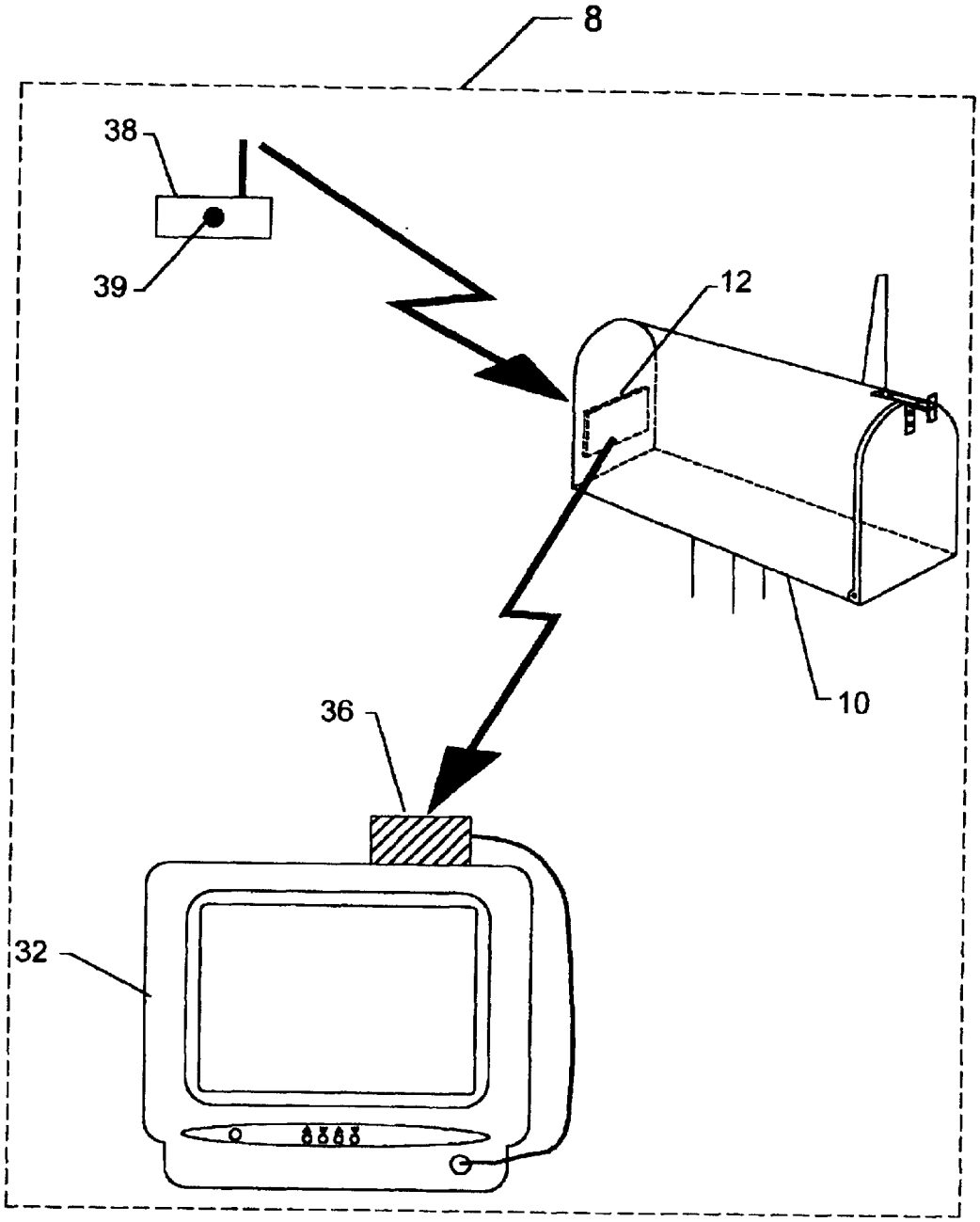
FIG. 4 shows how radio frequency transmissions are transmitted and received from the control switch, analog video image receiver and instantaneous image transmission device.

FIG. 4 shows the preferred embodiment of the radio transmissions between the RF receiver 36, analog video transmission device 12, and battery powered RF transmitter, 38. Battery-powered RF transmitter 38 is turned on by pressing and holding contact switch 39 which sends a radio -on- signal to analog video transmission device 12, turning it on. Analog video transmission device 12 then transmits a real time image to RF receiver 36 and then to television 32 or alternately a video monitor.

Figure 5A:
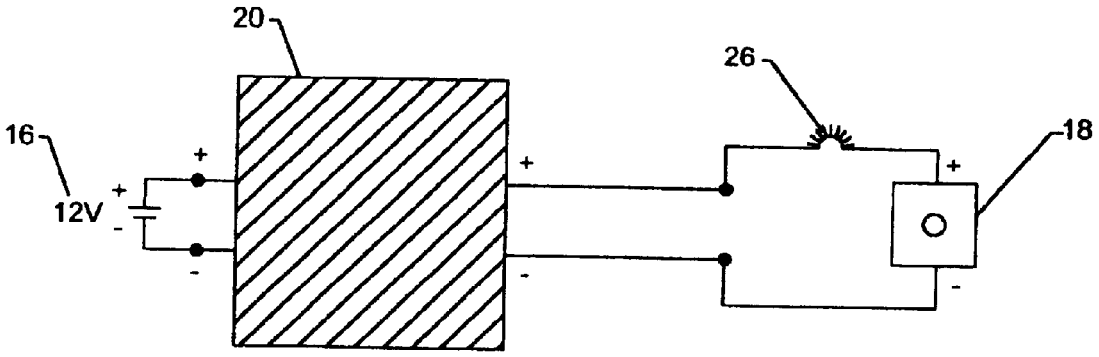
FIGS. 5A, 5B and 5C show preferred and optional wiring diagrams for the instantaneous image transmission device and solar cells.

The preferred wiring embodiment for analog video transmission device 12 is depicted in FIG. 5A. Analog video camera/transmitter 18 is connected in series with light source 26 and then to remote RF receiver/controller 20.

Figure 5B:
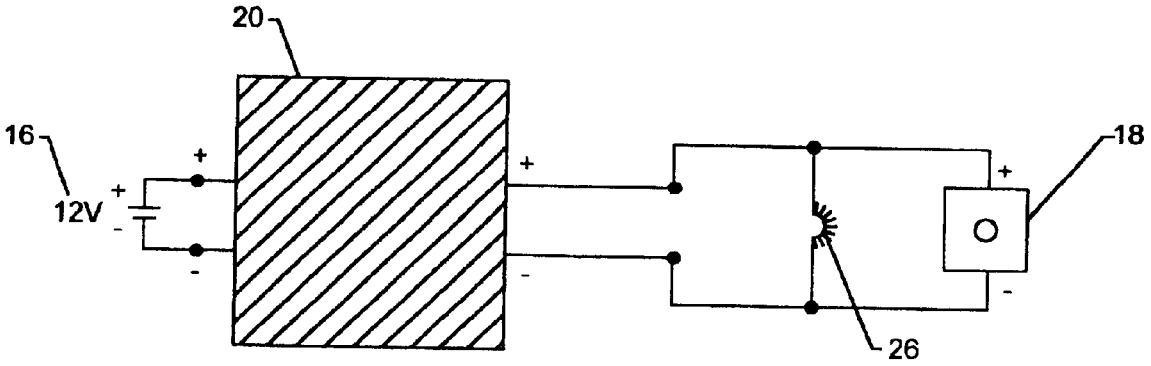

An alternate wiring diagram is depicted in FIG. 5B. Analog video camera/transmitter 18 is connected in parallel with light source 26 and then to remote RF receiver/controller 20.

Figure 5C:
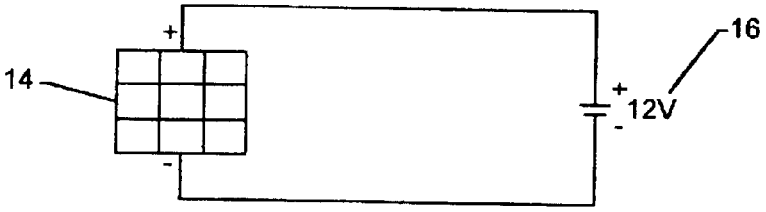

FIG. 5C depicts the wiring diagram of solar cell 14, where solar cell 14 is attached directly to battery pack 16.

From the description above several advantages of the instantaneous remote mail viewing system become apparent:

(a) The instant invention provides the user the ability to view the contents 41 of a mailbox 10 in real time eliminating the need to travel to the mailbox 10 to examine the contents 41 or lack thereof.

(b) The device 8 allows the user to check for potentially hazardous or dangerous devices that may be present in the mailbox 10 from a safe distance without the need to actually approach or open the mailbox 10.

(c) The invention allows the user to examine the contents 41 of the mailbox 10 remotely with a minimum of equipment or added electronic systems. It can be attached directly to the mailbox 10 and a television 32 and does not require computers or other types of expensive digital devices to access the image of the mail in the mailbox 10.

(d) The device 8 has a low power drain that insures long battery life and increases the length of time between battery replacement intervals.

(e) The device 8 can be powered by both a battery power pack 16 and solar cell 14 to increase the battery replacement interval to the life of the unit.

The Mailboxcam instantaneous remote mail viewing system 8 is normally in standby mode. Remote RF receiver/controller 20 in FIG. 2 is normally in standby/low power consumption mode waiting for a RF signal to activate the unit. The user turns the power on for television 32 and receiver for analog transmission 36 in FIG. 4. The user activates power button 39 on battery powered transmitter 38. Battery powered transmitter 38 then sends a radio frequency signal to instantaneous image transmission device 12 as shown in FIG. 4. Instantaneous image transmission device 12 goes from low power-standby mode to transmit power-on mode and transmits an instantaneous analog image of the interior of mailbox 10 to RF receiver 36 as shown in FIG. 4. RF receiver 36 sends the signal to television 32 for viewing by the user. When the user releases power button 39, the RF transmission stops and instantaneous image transmission device 12 goes from transmit power-on mode to low power, standby mode and the image stops.

FIG. 2 shows the details of instantaneous image transmission device 12. Instantaneous image transmission device 12 is normally in low power consumption-standby mode and only remote RF receiver/controller 20 is active. When remote RF receiver/controller 20 receives a radio signal it activates an internal circuit that powers light source 26 and analog video camera/transmitter 18. Analog video camera/transmitter 18 converts the image to a radio frequency transmission and transmits it through antennae 24.

FIG. 5A shows the preferred wiring method for remote RF receiver/controller 20, light source 26 and analog video camera/transmitter 18. In the preferred embodiment, light source 26 and analog video camera/transmitter 18 are wired in series and then connected to remote RF receiver/controller 20.

FIG. 5B shows an alternate wiring method for remote RF receiver/controller 20, light source 26 and analog video camera/transmitter 18. In an alternate embodiment, light source 26 and analog video camera/transmitter 18 are wired in parallel and then connected to remote RF receiver/controller 20.

FIG. 5C shows the preferred embodiment to extend the life of battery power source 16. A solar cell 14 is wired directly to charge battery power source 16 during periods of sunlight, increasing battery life. It is preferred that solar cell 14 be of the type with a built-in diode circuit to eliminate power loss during times of low sunlight.

The Mailboxcam Instantaneous Remote Mail Viewing System 8 makes it possible to view the contents of a mailbox 10 in real time, instantaneously, without the need for data acquisition devices or computers. The simple system 8 has a low power drain in standby mode and only uses power while transmitting for short periods of time. The system 8 makes it possible to not only tell if mail has been removed but also if new mail has been delivered and what type of mail is present.

The Mailboxcam Instantaneous Remote Mail Viewing System 8 significantly lowers the risk of vandalism or terrorism since the user can view the inside of the mailbox 10 without opening it. Any illegal material such as a pipe bomb can be viewed without opening the mailbox 10 and exposing the user to serious risk of injury. Furthermore the Mailboxcam Instantaneous Remote Mail Viewing System 8 has the additional advantages in that;

the type of mail 41 can be examined without opening the mailbox 10, insuring that a needless trip to the mailbox 10 is not made to check on mail waiting to be picked up;

the system 8 uses a minimum of components and does not need computers or other digital equipment to operate;

the size of image transmission device 12 is small and can easily fit in any mailbox 10 and is easy to mount in the mailbox 10;

image transmission device 12 in the mailbox 10 can be solar charged making the battery power last for years;

image transmission device 12 in the mailbox 10 is completely self-contained and does not need any additional power source or wiring;

the system 8 transmits and receives on different frequencies increasing the system's 8 reliability and eliminating false transmission signals and interference.

Although the description above contains many specific details, these should not be construed as limiting the scope of the invention but as merely providing illustrations of some of the presently preferred embodiments of the invention. For example, the remote RF receiver/controller 20 described in the specification can be manufactured on a lithographed circuit board significantly decreasing the size of the component and lowering the power drain even further. The remote RF receiver/controller 20 can be encased in a plastic housing with a clear front for operation of the video camera but it can also be encased in a potting compound such as urethane.

Many different battery power sources can be used such as alkaline, nickel cadmium, lithium ion and others. The tern battery power pack is meant to include all battery systems known in the state of the art. Similarly there are many different types of RF receivers/controllers, RF transmitters and RF receivers with video transmission capabilities that are known in the state of the art that operate on different frequencies. Also the term light source can include incandescent, quartz, LED, fluorescent and other types of light as are known in the state of the art.

Thus the scope of the invention should be determined by the appended claims and their legal equivalents, rather than by the examples given.

I claim:

1. An instantaneous remote mail viewing system for a mailbox comprising;

(a) an instantaneous analog image transmitter with a low power, standby mode, (b) an instantaneous analog image receiver capable of receiving a transmitted RF signal from said instantaneous analog image transmitter, and then converting the RF signal into a format usable by video monitor and transmitting the converted signal to said video monitor in such a manner as to display an image, (c) a radio frequency transmitter capable of sending a "power on" command to said instantaneous analog image transmitter whereby the image transmitter is turned on and an image of an interior of a mailbox may be viewed instantaneously on said video monitor.

2. The instantaneous remote mail viewing system of claim 1 where said instantaneous analog image transmitter comprises an analog video camera and radio frequency transmitter and a radio frequency receiver wherein the radio frequency receiver waits in a low power standby mode for a RF signal prior to applying power to said analog video camera and RF transmitter.

3. The instantaneous remote mail viewing system of claim 2 where said analog video camera comprises a CMOS analog video camera.

4. The instantaneous remote mail viewing system of claim 1 where said video monitor is a television set.

5. The instantaneous remote mail viewing system of claim 1 where said instantaneous analog image receiving device and said radio frequency transmitter device capable of sending an on command to said instantaneous analog image transmission device is combined in one unit.

6. An instantaneous remote mail viewing system for a mailbox comprising;

(a) an instantaneous analog image transmission device with a low power, standby mode, (b) an instantaneous analog image receiving device capable of sending a video image to a video monitor that is combined with a radio frequency transmitter capable of sending a "power on" command to said instantaneous analog image transmission device whereby an image of an interior of a mailbox may be viewed instantaneously on a video monitor.

7. An instantaneous remote mail viewing system for a mailbox comprising;

(a) an analog video camera and radio frequency transmitter, (b) an electrical power source, (c) an electrical light source, (d) a remote radio frequency receiver/controller with a built in low power standby mode, (e) a radio frequency receiver for receiving an analog image by radio frequency transmission from said video camera and radio frequency transmitter, said receiver capable of sending a signal to a video monitor, (f) a hand held radio frequency transmitter with a power switch capable of transmitting a "power on" command to said remote radio frequency receiver/controller.

8. The instantaneous remote mail viewing system of claim 7 where said analog video camera is a CMOS camera.

9. The instantaneous remote mail viewing system of claim 7 where said electrical power source is a battery pack.

10. The instantaneous remote mail viewing system of claim 7 where said electrical power source is a battery pack in combination with a solar cell.

11. The instantaneous remote mail viewing system of claim 7 where said electrical light source is selected from the series comprising incandescent lights, quartz halogen lights, light emitting diodes or fluorescent lights.

12. The instantaneous remote mail viewing system of claim 7 where said radio frequency receiver for receiving an analog image by radio frequency transmission from said video camera/radio frequency transmitter and said radio frequency transmitter with a power switch capable of transmitting an -on- command are combined in one unit.

* * * * *